US012037793B2

(12) United States Patent
Blizzard et al.

(10) Patent No.: US 12,037,793 B2
(45) Date of Patent: Jul. 16, 2024

(54) PORTABLE COVER STRUCTURE

(71) Applicants: James Blizzard, Chapin, SC (US); Allison Blizzard, Chapin, SC (US)

(72) Inventors: James Blizzard, Chapin, SC (US); Allison Blizzard, Chapin, SC (US)

( * ) Notice: Subject to any disclaimer, the term of this patent is extended or adjusted under 35 U.S.C. 154(b) by 0 days.

(21) Appl. No.: 17/339,166

(22) Filed: Jun. 4, 2021

(65) Prior Publication Data

US 2023/0287687 A1 Sep. 14, 2023

(51) Int. Cl.
*E04F 10/02* (2006.01)
*B63B 17/02* (2006.01)

(52) U.S. Cl.
CPC ..... *E04F 10/02* (2013.01); *B63B 17/02* (2013.01)

(58) Field of Classification Search
CPC ..... E04F 10/02
See application file for complete search history.

(56) References Cited

U.S. PATENT DOCUMENTS 2,190,566 A * 2/1940 Julian ..... E04H 15/30 D21/837
3,042,053 A * 7/1962 Effie ..... E04H 15/003 135/130
3,394,720 A * 7/1968 Moss ..... E04H 15/003 D21/837
4,096,874 A 6/1978 Weatherly
4,363,284 A 12/1982 Monroe
5,080,123 A * 1/1992 Stein ..... E04H 15/003 135/900
5,419,273 A 5/1995 Cutler
5,546,971 A * 8/1996 Leonhardt ..... E04H 15/003 135/909
5,823,217 A * 10/1998 Rice ..... E04H 15/40 135/900
5,927,311 A * 7/1999 Jager ..... E04H 15/003 135/124
6,062,243 A 5/2000 Tuch et al.
7,059,660 B1 * 6/2006 Juola ..... E04H 15/06 135/88.03
7,721,361 B1 * 5/2010 Shubert ..... E04H 4/084 4/494
7,913,710 B2 3/2011 Bougioukos
8,286,651 B1 10/2012 Maffett
(Continued)

FOREIGN PATENT DOCUMENTS

WO WO2007082403 A1 7/2007

*Primary Examiner* — Noah Chandler Hawk
(74) *Attorney, Agent, or Firm* — Southeast IP Group LLC; Thomas L. Moses

(57) ABSTRACT

A portable cover structure includes a pair of flexible poles that are disposed in a generally parallel fashion, and a sunscreen that is attached to the poles on opposed sides thereof, so that the sunscreen is stretched between the poles. One end of each bendable pole may be removably attached to a structure, such as a dock, and the other end of each pole is preferably connected to an adjustable strap or cord. The distal end of the strap or cord may be attached to a dock, a cleat or a boat, and may include a snap-fit mechanism for such removable attachment. The cover structure may alternate between a first position over a dock and a second position over a boat, as desired. When not in use, the portable cover structure may be disassembled and stored in a bag or container.

9 Claims, 5 Drawing Sheets

(56) References Cited

U.S. PATENT DOCUMENTS

| | | | | |
|---|---|---|---|---|
| 9,216,798 | B2 | 12/2015 | Kent | |
| 9,290,961 | B2 * | 3/2016 | Nichols | E04H 15/005 |
| 9,556,640 | B2 | 1/2017 | Levin | |
| 9,776,687 | B2 | 10/2017 | Levin | |
| 9,777,504 | B2 | 10/2017 | Levin | |
| 10,272,971 | B2 | 4/2019 | Levin | |
| 10,557,284 | B2 | 2/2020 | McMillen, Jr. et al. | |
| 2008/0016786 | A1 | 1/2008 | Bougioukos | |
| 2011/0120514 | A1 | 5/2011 | Skrzynski | |
| 2018/0251196 | A1 | 9/2018 | Craig | |
| 2021/0262219 | A1 * | 8/2021 | Hannon | E04B 1/3205 |

* cited by examiner

PORTABLE COVER STRUCTURE

FIELD OF THE INVENTION

The present invention relates to a portable covering that may be used for boats and docks, as well as in other applications. More specifically, the present invention is directed to a collapsible frame structure that may be removably attached to a dock, and which includes a flexible sunscreen that is attachable to the frame structure. The portable cover structure is primarily used to cover a dock and/or boat in order to provide shade and shelter from sun and weather.

BACKGROUND OF THE INVENTION

Heretofore, many attempts have been made to develop and commercialize various types of coverings for docks and boats. Some are fixed structures, while others are portable and collapsible. The following references disclose various wind-screen type mechanisms, and these documents are hereby incorporated herein by reference, in their entireties:

U.S. Pat. No. 4,096,874 Weather Shelter

A first plurality of like shelter supports lie in equidistantly horizontally spaced parallel vertical planes. Each support consists of a curved elongated unit having a central section resembling the letter C. Each section has a lower end portion which extends vertically below the section and terminates in a bottom end. Each section has an upper end portion which is shorter than the lower end portion and extends upwards and outwards to form a stub. A second plurality of horizontally elongated connector members are provided. There is one less connector member than supports. Each connector member is connected at each end to a stub of a corresponding one of a corresponding pair of next-adjacent supports and extends horizontally therebetween whereby the combination of supports and connector members defines a frame. A flexible waterproof cover is applied over said frame and is secured thereto. The cover has an opening extending vertically from the stubs to the lower end portions and extending horizontally along the entire frame.

U.S. Pat. No. 4,363,284 Dock Side Boat Cover

A cover for protecting the interior of a boat from the surrounding environment. The cover has first and second vertical supports connected to a dock. A horizontal member is connected with the first and second vertical supports to form a frame. First and second brackets are located on the first and second vertical supports. The first and second brackets have arms attached thereto that extend from the dock toward the water. A canopy is attached to the arms. A winch has cables connected to the first and second brackets to move the canopy with respect to the boat from a first position where flaps surround that portion of the boat out of the water, to a second position which allows unhampered ingress and egress between the boat and dock.

U.S. Pat. No. 5,419,273 Portable Marine Shelter

A portable marine shelter that includes a frame assembly having two lower spaced apart longitudinally extending members, or float bars, and a flexible cover that fits over the frame assembly to provide an enclosure to store a boat and the like. A floatation system includes numerous sphere-shaped floats that are rotatably attached to the lower frame members, the floats are also free to move longitudinally along predetermined sections of the lower frame members. The floats are substantially equally distributed between the two lower members and along each individual member. The loosely attached floats enables the shelter to accommodate wave and wind generated motion without unduly stressing the frame assembly of the boat sheltered therein. The entire shelter is loosely attached to a dock and loosely anchored to the bottom of the lake, etc. to provide a structure that securely protects a boat yet is capable of being moved easily to different locations.

U.S. Pat. No. 6,062,243 Floating Shelter

A floating shelter has a semicircular frame defining an open-ended tunnel with an unobstructed ingress and egress. The frame has straight frame members forming the base of the open-ended tunnel. The roof of the open-ended tunnel is formed by curved frame members working together with a canopy top. A tensioning assembly mounted to each bottom corner of the canopy top engages the curved frame members forming the entrance and exit of the tunnel. Floats are fitted about the straight frame members forming the base of the open-ended tunnel for flotation of the frame.

U.S. Pat. No. 7,913,710 Shading Systems

A system for improved exterior shading devices of highly adaptable configurations. The system comprises several cantilever shade structures usable in the shading of land vehicles.

U.S. Pat. No. 8,286,651 Retractable Boat Slip Cover

Boat slip cover systems are provided for affixing to piers having a plurality of slips with closed and open ends, and first and second sides. Each boat slip cover includes a flexible canopy. Fixed supports for a first end of the canopy are disposed about the closed end of the slip, at least one extending upward from and perpendicular to the pier surface, and at least one extending upward from and angular to the pier surface. Rotating supports are disposed along each side of the slip and extend upward from the pier. Telescoping joints are disposed along each rotating support for their extension or retraction. A winch device is further provided for manual positioning. A convertible pier cover includes various retractable boat slip covers, valley portions extending between adjacent boat slip covers and forming an attachment on each side to an adjacent boat canopy, and a central aisle canopy.

U.S. Pat. No. 9,216,798

A covering system for removably covering a vehicle, such as a boat, that includes a plurality of rotatively anchored swing arms rotatable between a covered position and an uncovered position. Each swing arm includes a mount and a pretensioner formed of one or more stays adjustably attached to part of a shaft of the arm to adjust an applied preload and transfer forces encountered during operation to part of the shaft rotatively anchored by the mount to a grounded structure such as a piling or post of a dock. The swing arms are pivotally connected to an elongate transversely extending carriage from which a cover is suspended with a boom of each arm connected to the carriage by a pivot assembly that also facilitates carriage and cover position adjustment. A pivot limiter can be included that limits or even stops pivoting of the carriage relative to the swing arm boom.

U.S. Pat. No. 9,556,640 Cantilevered Watercraft Canopy

In a cantilevered watercraft canopy, a plurality of vertical supports provides support to a plurality of horizontal supports. First and second main struts are supported by the horizontal supports. First and second pluralities of arch members are affixed at a central attachment point to the first main strut and second main strut, respectively. The outer ends of the first and second pluralities of arch members support outer struts. In the first exemplary embodiment, the inner ends of the first and second pluralities of arch members are affixed to one another, and the main struts are affixed rigidly to the horizontal supports. In the second exemplary embodiment, first and second inner struts are affixed to the inner ends of the first and second pluralities of arch members, and the main struts are affixed rotatably to the horizontal supports. A canopy cover is affixed over the arch members and struts.

U.S. Pat. No. 9,776,687 One-Sided Cantilevered Watercraft Canopy

A cantilevered canopy structure includes at least one vertical support having a first and second upper support joint. The structure further includes at least one first and second horizontal support. The first horizontal support is affixed to the vertical supports at the first upper support joint. The second horizontal support is affixed to the vertical supports at the second upper support joint. The structure further includes cantilever supports. The cantilever support is affixed to the first and second horizontal supports. The structure further includes at least one horizontal frame member. The horizontal frame member is affixed to the cantilever supports at a cantilever frame joint. The first upper support joint is located higher than the second upper support joint. The first upper support joint and second upper support joints are distal, in opposing directions, from the vertical support.

U.S. Pat. No. 9,777,504 Cantilevered Watercraft Canopy

In a cantilevered watercraft canopy, a plurality of vertical supports provides support to a plurality of horizontal supports. First and second main struts are supported by the horizontal supports. First and second pluralities of arch members are affixed at a central attachment point to the first main strut and second main strut, respectively. The outer ends of the first and second pluralities of arch members support outer struts. In the first exemplary embodiment, the inner ends of the first and second pluralities of arch members are affixed to one another, and the main struts are affixed rigidly to the horizontal supports. In the second exemplary embodiment, first and second inner struts are affixed to the inner ends of the first and second pluralities of arch members, and the main struts are affixed rotatably to the horizontal supports. A canopy cover is affixed over the arch members and struts.

U.S. patent Ser. No. 10/272,971 Watercraft Canopy for U-shaped Dock

A canopy structure includes arch members defining a barrel vault and horizontal members. Each of the upper horizontal members is affixed to the parallel arch members. The canopy structure further includes arched vertical supports. The upper horizontal supports are affixed to the arched vertical supports. The canopy structure further includes lower horizontal members. Each of the lower horizontal members is affixed to the parallel arch members. According to another aspect, a canopy structure includes a U-shaped dock surrounding a watercraft mooring area. The canopy structure includes inner dock arm edges located on opposite sides of the watercraft mooring area. The canopy structure further includes vertical supports affixed to at least two of the inner dock arm edges. The vertical supports support a canopy frame. The canopy frame defines a barrel vault.

U.S. patent Ser. No. 10/557,284 Fastening a Portable Shade Apparatus to a Fence to Provide Shade A portable shade apparatus includes a sheet of material, a set of cables, and a set of flexible rods coupled to the sheet of material and the set of cables. Each flexible rod has (i) a first end section which projects from the sheet of material, (ii) a second end section which fastens to a respective cable, and (iii) an inner section between the first end section and the second end section. The inner section provides support to the sheet of material.

U.S. Patent Publication No. 20080016786 Shading Systems

A system for improved exterior shading devices of highly adaptable configurations. The system comprises several cantilever shade structures usable in the shading of land vehicles.

U.S. Patent Publication No. 20110120514 Covering System

The present invention concerns apparatus and methods for covering and uncovering a desired object. Particular embodiments include a covering system comprising: a cover operably connected to a plurality of translational members translationally positioned along a track; two or more hangers having a vertically extending portion and an outwardly extending portion, the track being operably attached to the outwardly extending portion; means for mounting hangers in a rotatable arrangement to a structure about a vertical axis. A further embodiment of the present invention includes a method for covering and uncovering a desired object, the steps including: mounting each of two or more hangers to a structure in a rotatable arrangement, the two or more hangers having a vertically extending portion and an outwardly extending portion; suspending a track from the outwardly extending portion of the two or more hangers; suspending a cover from the track, the cover being translatable along the track; rotating the two or more hangers between a covering position and a stored position, the covering position being arranged to position the track above an object to be covered, and the stored position being arranged to position the track to a side of the object to be covered.

U.S. Patent Publication No. 2018025116 Retractable Cantilevered Watercraft Canopy System A retractable cantilevered watercraft whip mooring system has a retractable canopy which covers the watercraft while moored to a dock. The system includes a pair of whips secured to the dock by a pair of mounts. Each whip includes a tie-down line. Each whip includes a tie-down line. The retractable cantilevered watercraft whip mooring system protects the watercraft from rubbing or bumping against the dock. In addition, a retractable canopy slides over and is secured by the pair of whips. The retractable canopy includes a support batten. The watercraft is secured by the retractable cantilevered watercraft whip mooring system to protect the watercraft from rubbing or bumping against the dock. The canopy slides over the pair of whips. The canopy is securable relative to an exterior side of the watercraft, enabling the watercraft to be protected during severe weather conditions while the watercraft is attached to the dock.

Publication No. WO2007082403 Floating Boat Garage

The invention relates to a floating boat garage (1) for a watercraft (3) which is located in water. Said floating garage comprises a floating support structure (5) and a covering element which surrounds said support structure, consisting of awning cloth (4) which is stretched over said structure or plastic plates. Said floating support structure (5) rests on several longitudinal floating bodies (6) which are vertical in relation to the surface of the water and which act as fenders. The support structure consists of several curved or gable-shaped elements (7) which extend in the supports (12) from the lower side. Said supports are equipped with a longitudinal floating body (6) on the lower end thereof which extends in a vertical manner. Said curved and gable-shaped elements (7) are connected to at least two purlins (8) which extend in a transversal manner in relation to said elements.

Many of the canopies and covers set forth in the above-referenced documents are difficult to install, expensive, and are cumbersome to handle. Thus, it would be desirable to provide a dock and boat covering that is portable, collapsible, lightweight and easy to install.

BRIEF SUMMARY OF THE INVENTION

In accordance with one aspect of the invention, a first embodiment of a portable dock and boat cover structure includes a pair of flexible poles that are disposed in a generally parallel fashion, and a sunscreen that is attached to the poles on opposed sides thereof, so that the sunscreen is stretched between the poles. The poles may be of unitary construction, or may comprise sections that fit together but can be taken apart, similarly to tent poles. One end of each pole may be removably attached to a structure, such as a dock, and the other end of each pole is preferably connected to a strap, rope, string, cord or other type of line. The distal end of the strap or cord may be tied to a cleat on the dock, or may be attached to a dock in any suitable fashion.

In a first embodiment, the cover structure may be affixed to a dock, pier, or the like, so that the poles are attached adjacent the edge thereof, so that the cover structure may alternate between a position covering the dock, and a second position covering a boat, as shown in FIGS. 1 and 2. Because the poles are flexible, they may be bent so that the structure is bent over the dock, and the straps or cords are attached to cleats or quick-release mechanisms on an opposed side of the dock or pier from where the poles are attached. In this position, the cover structure provides shade over that portion of the dock.

When a boat is moored to the dock in a position adjacent to the location where the poles are attached thereto, the cover may be unsecured from the opposed side of the dock, and the structure may be bent in the opposite direction so that the cover structure extends over the boat, as shown. The straps or cords may then be removably attached to the opposite side of the boat from the dock in any desired manner, including securing the straps or cords to cleats or other fixtures secured to the boat, or by attaching the quick-connect mechanism to mounts on the boat. In this way, the cover structure may alternate between a position over the dock, and a second position over the boat, due to the flexible nature of the poles.

In another embodiment, a pair of such structures may be employed, with one portable cover extending over a dock, and a second portable cover extending over a boat. In this embodiment, the second portable cover may be positioned so that the poles are attached to the dock so that the cover extends outwardly, away from the dock, and over a boat, as shown in FIG. 3. The straps at the distal end of the second portable cover may be attached to the boat in any suitable fashion, such as tying the straps to a cleat affixed to the boat, or using a quick-connect mechanism that connects the strap or cord to the far side of the boat. In this embodiment, it should be understood that the pair of cover structures may be connected to one another in some fashion, or may simply be employed as separate cover structures with no connection therebetween.

It is contemplated that a mount may be secured to the dock, and may temporarily receive one end of the poles for temporary setup. Alternatively, the poles may be fixed to the dock in any suitable manner, whether permanently attached or removable.

BRIEF DESCRIPTION OF THE DRAWINGS

These and other features, aspects, and advantages of the present invention will become better understood with regard to the following description, appended claims, and accompanying drawings where:

FIG. 5 is a perspective view of one embodiment of a cord used to secure a portable cover structure to a cleat on a dock, pier, or the like.

DETAILED DESCRIPTION OF THE INVENTION

Figure 1:
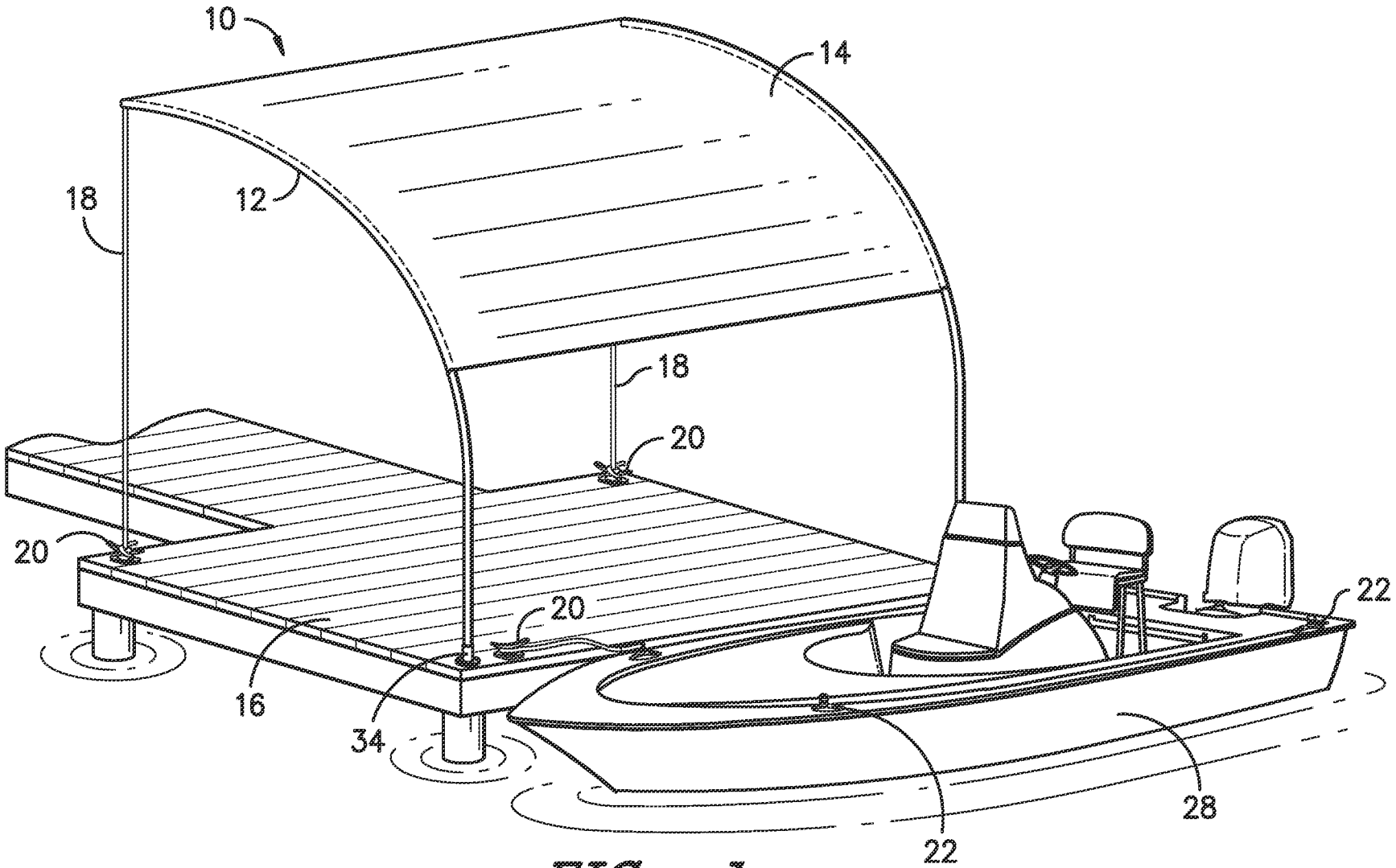
FIG. 1 is a perspective view of one embodiment of a portable cover structure that is removably affixed to a dock, wherein the cover structure includes a pair of flexible poles, a sunscreen attached to the flexible poles, and a pair of cords, each cord having a first end attached to a distal end of a flexible pole and the second end of the cord tied to a cleat on the dock.

The present invention includes, in a first embodiment, a portable cover structure 10 includes a pair of flexible poles 12 disposed in generally parallel relation, wherein a flexible sunscreen 14 is attached to each pole and stretched therebetween, as shown in FIG. 1. The poles 12 may be of singular, unitary construction, or they may be formed by assembling multiple sections of poles together, similarly to tent poles. In one embodiment, the poles 12 may be disassembled into smaller sections that may be fitted together in longitudinal fashion, so that the length of each pole may be adjusted by adding or subtracting sections of the pole 12 to achieve the desired length. In another embodiment, the pole sections may be disassembled, but may be held together by an elastic cord that extends longitudinally through all of the pole sections for a particular pole, similarly to many tent poles that are commercially available today. The sunscreen 14 may be made from any suitable, flexible material, and the sunscreen 14 may be permanently attached to the poles 12, or may be removable therefrom.

As shown in FIG. 1, the poles 12 may be temporarily or permanently affixed to a dock 16 at one end (or on one side thereof, as desired), so that the other end extends over the dock 16 to provide shade and shelter over the dock 16. The free end of each pole 12 may include a strap or cord 18 that may be secured to the dock 16 in any suitable fashion. For example, the cord 18 may be attached to the end of the pole 12 at one end thereof, and the other end may be tied to a dock cleat 20 or other structure. Alternatively, the end of the cord may include a snap-fit mechanism 22 including a male portion 24 that removably mates with a mount 26 or socket that is affixed to the dock 16. In a preferred embodiment, when the cords 18 are attached to the dock 16, the poles 12 tend to bend into an arc, as shown, due to their flexible nature.

Figure 2:
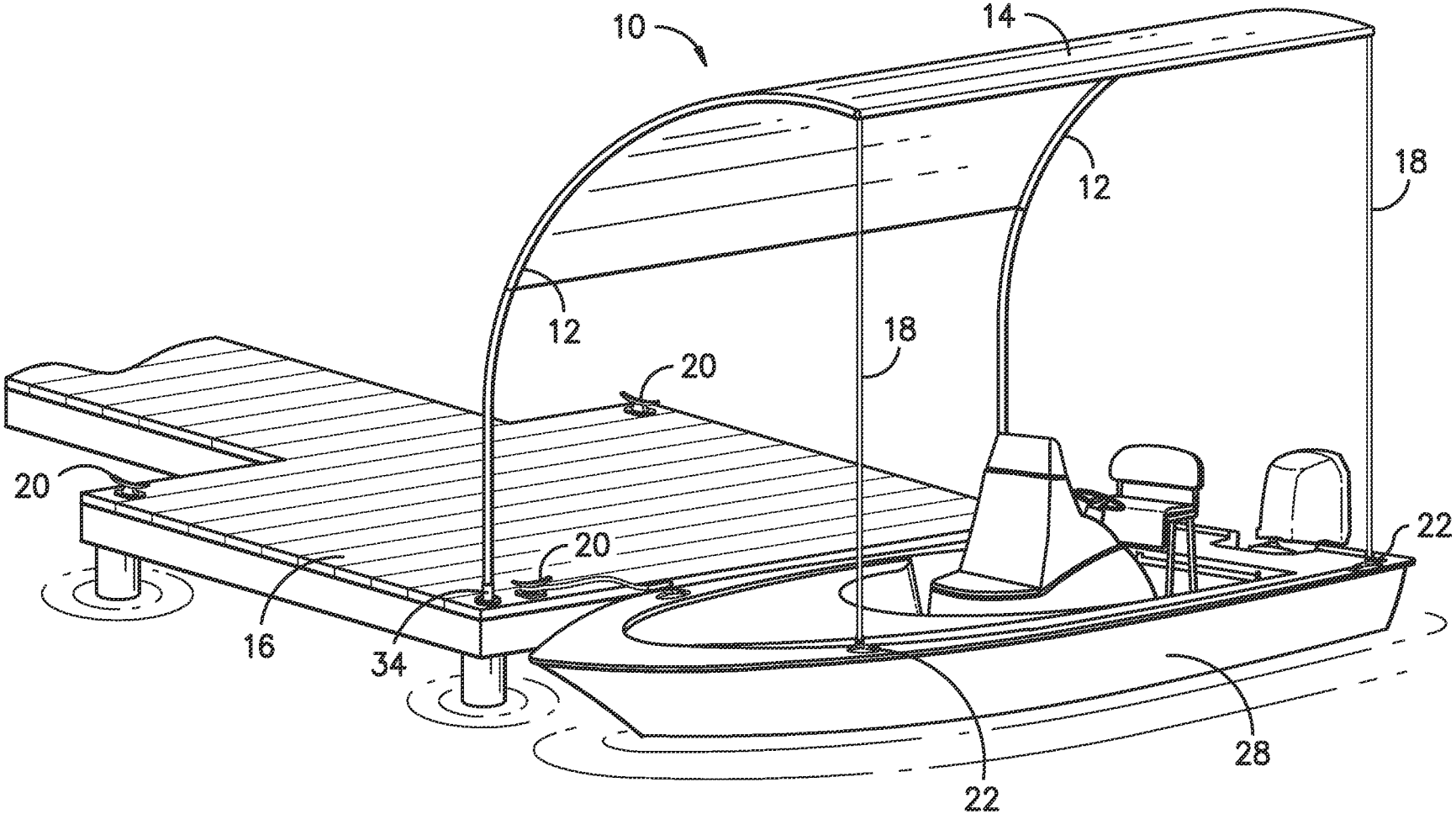
FIG. 2 is a perspective view of one embodiment of a portable cover structure that is removably affixed to a dock, wherein the cover structure includes a pair of flexible poles, a sunscreen attached to the flexible poles, and a pair of cords, each cord having a first end attached to a distal end of the flexible poles and the second end of the cord attached to a snap fit mechanism for a securement to a boat.

In a first embodiment, the portable cover structure 10 may be affixed to a dock 16, pier, or the like, so that the poles 12 are attached adjacent the edge thereof, so that the cover structure 10 may alternate between a position covering the dock 16, and a second position covering a boat 28, as shown in FIGS. 1 and 2. Because the poles 12 are flexible, they may be bent so that the structure is bent over the dock 16, and the straps or cords 18 are attached to cleats 20 or quick-release mechanisms 22 on an opposed side of the dock 16 or pier from where the poles 12 are attached. In this position, the portable cover structure 10 provides shade over that portion of the dock 16.

Figure 4:
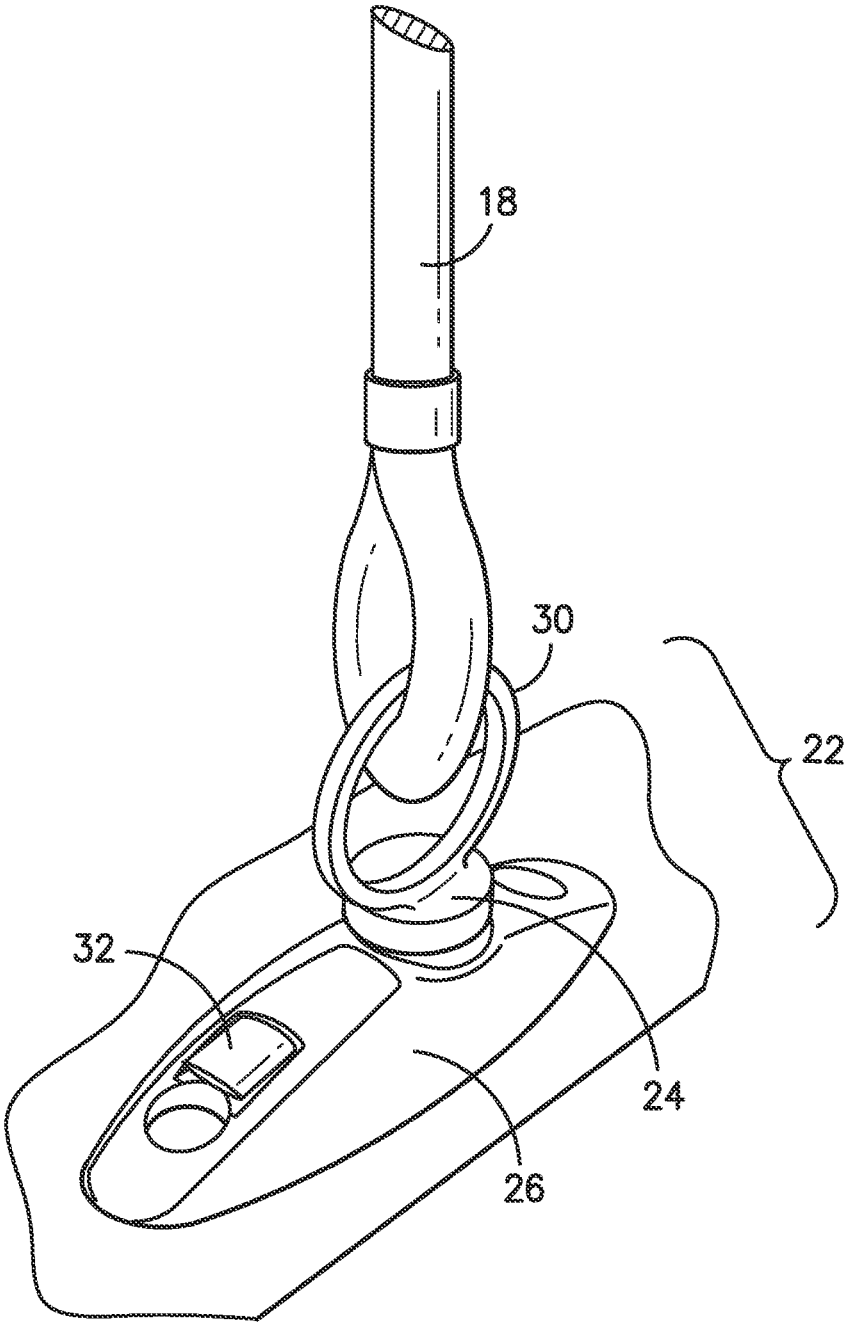
FIG. 4 is a perspective view of one embodiment of a snap-fit mechanism used to attach a cord to a boat or dock, wherein the cord is attached to one end of a pole that forms part of the portable cover structure.
Figure 5:
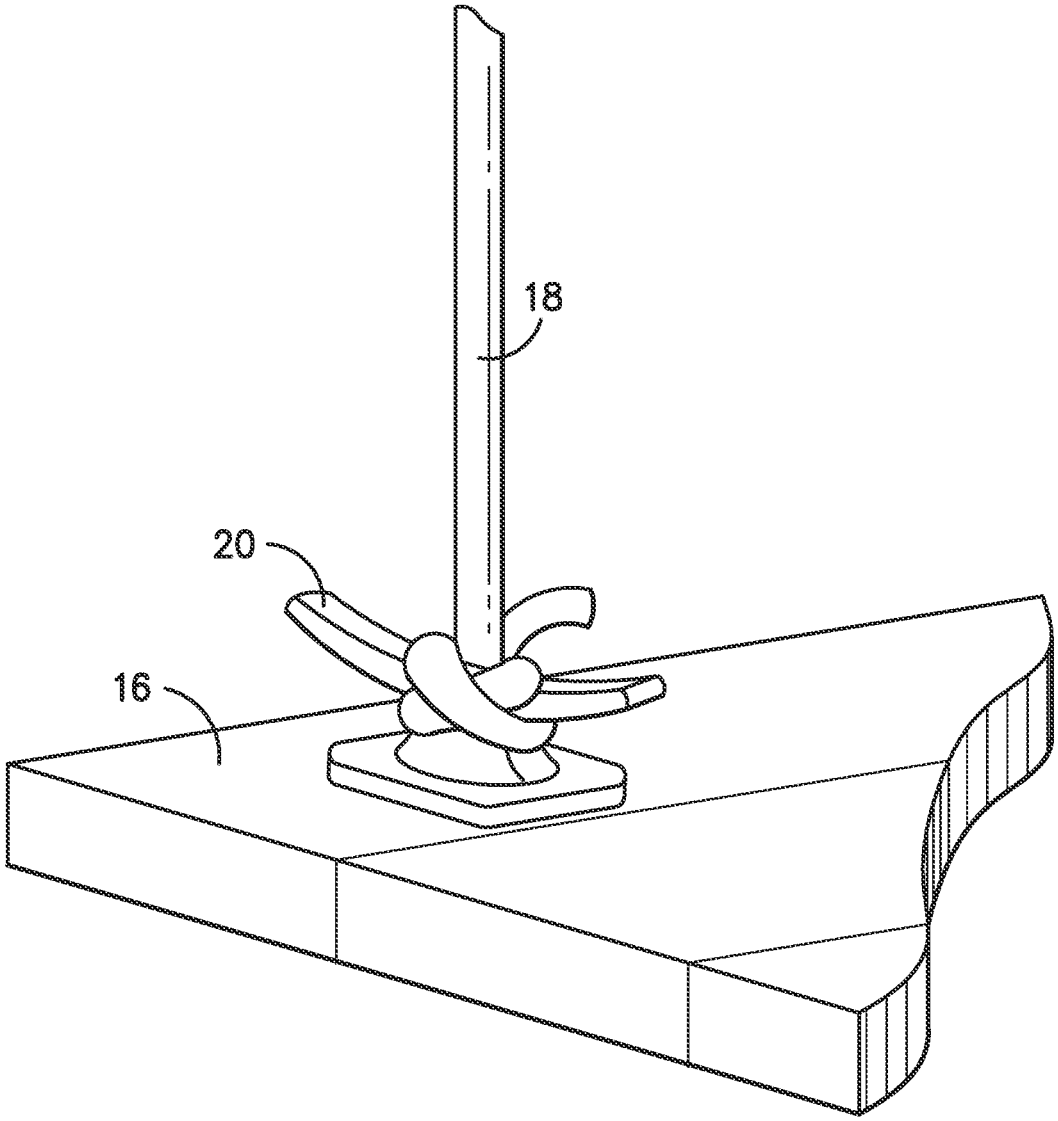

Alternatively, the poles 12 of the portable cover structure 10 may be bent outwardly, so that the cover structure provides shade over a boat that is in the water and moored to the dock, as shown in FIG. 2. In this position, the poles 12 are affixed to the dock 16 (either in permanent fashion, or removably), and the cords or straps 18 at the distal end of the poles 12 are preferably affixed to a boat 28, either by removably securing them to cleats 20 or other structures on or affixed to the boat 28, or via a snap-fit mechanism 22, and example of which is shown in FIG. 4. In this way, the portable cover structure 10 may alternate between a position over the dock 16, and a second position over the boat 28, as desired, due to the flexible nature of the poles 12.

Figure 3:
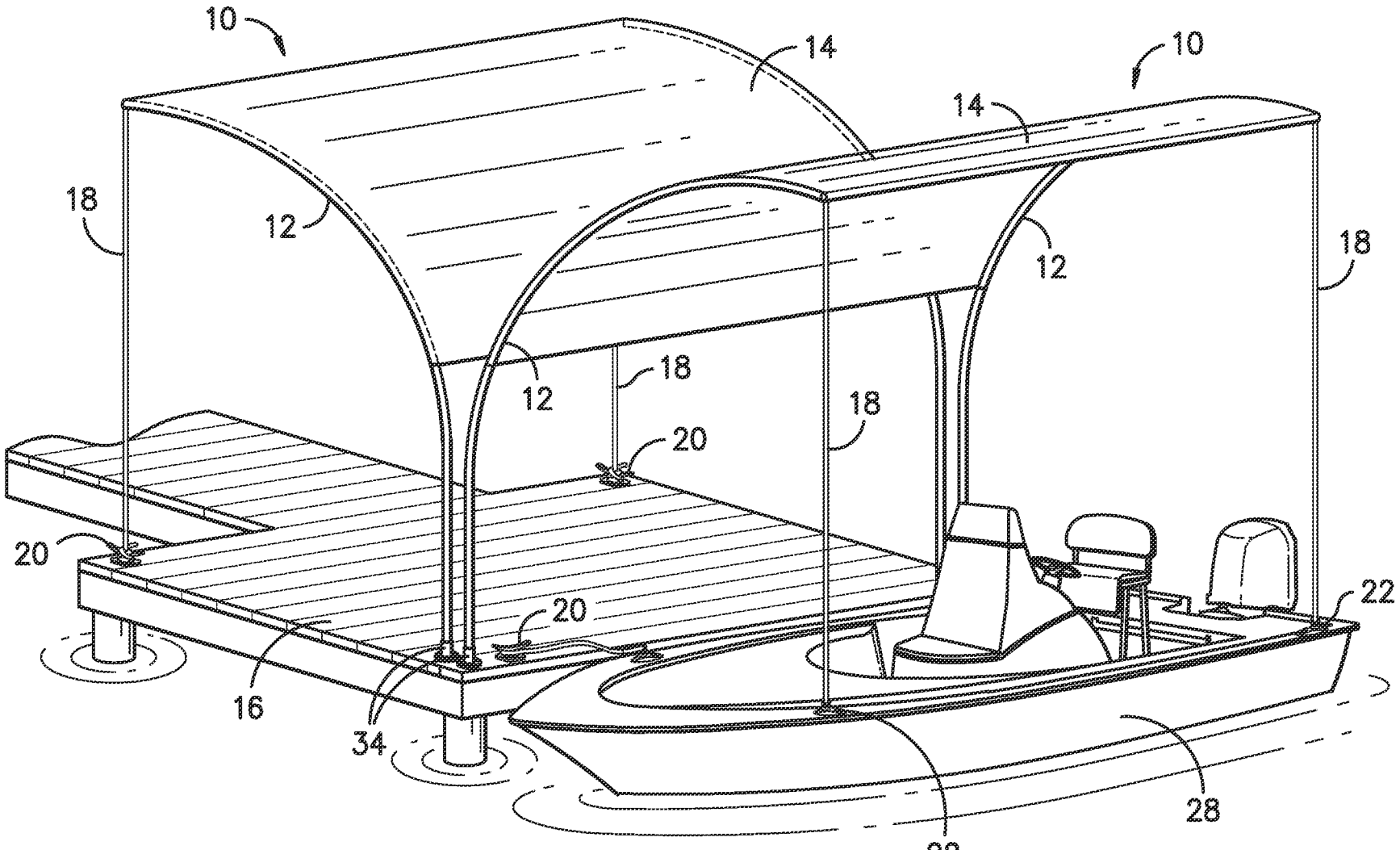
FIG. 3 is a perspective view of one embodiment of a pair of portable cover structures that are removably affixed to a dock and a boat, wherein a first portable cover structure extends over a dock and a boat, wherein a first portable cover structures extends over a dock and the second portable cover structure extends outwardly, away from the dock, and extends over a boat.

In another embodiment, two portable cover structures 10 may be employed, as shown in FIG. 3, wherein one cover structure 10 is positioned over the dock 16, and the second cover structure 10 is positioned over a boat 28 that is tied or otherwise temporarily secured to the dock 16. In this embodiment, it is contemplated that the two portable cover structures 10 may simply work independently of one another, or they may be connected to one another via connectors in order to provide additional stability during periods of high wind or inclement weather.

In a preferred embodiment, the straps or cords 18 may include adjustment means, such as an adjustable buckle or the like, so that they may be lengthened or shortened, as desired, in order to position the cover structure at a suitable height or orientation. The distal ends of the straps or cords 18 may include a snap-fit mechanism 22, as shown in FIG. 2. In this embodiment, the snap fit mechanism 22 includes a male member 24 having a generally circular portion at one end and an eye 30 on the other end for tying the cord or strap 18, and a mount 26 having a complementary female member, so that the male member 24 may be removably inserted into the female member, and a spring loaded latch maintains the connection between the male 24 and female 26 members of the snap-fit mechanism 22. A sliding button 32 may be used to release the spring loaded latch, so that the end of the cord or strap 18 may be removed therefrom. The female mount member 26 may be attached at any desired location on the dock 16 or on a boat 28, so that the straps or cords 18 of the portable cover structure 10 may be quickly and easily attached thereto, and removed therefrom, as desired. It is further contemplated that the cords or straps 18 may have elastic qualities, so that they stretch, or they may be inelastic.

The sunscreen 14 may be made from any suitable material, such as canvas, nylon, polyester, or any other suitable type of plastic, and should be capable of being rolled up or folded, as desired, for transport and storage purposes. Additionally, the sunscreen 14 may be opaque, translucent, or may be made from a clear or tinted polymeric material that preferably provides protection against ultraviolet rays. Optionally, the poles 12 may include lights or light strips, such as LED light strips, which may be battery operated, or may be plugged into an electrical outlet, USB port, or any other type of power source. The lights may be operated remotely, by a remote control, as desired.

Dock mounts 34 for the poles 12 may be installed on a dock 16, similarly to rod holder mounts, wherein each pole mount 34 defines a hole for receiving the bottom portion of the pole 12. These mounts 34 may also include a snap-fit mechanism that allows the poles 12 to be snapped into the mount 34, and which allows the poles 12 to be removed from the mounts 34 when not in use.

The portable cover structure 10 may be disassembled when not in use, and rolled up or folded for storage in a bag or other container, in the same manner as a tent is folded up or stuffed into a stuff sack, along with the poles 12 in a disassembled state.

In use, the portable cover structure 10 may be positioned over and removably affixed to a boat 28 while the boat 28 is moored to a dock 16 until a user wishes to run the boat. At that point, the user may detach the straps or cords 18 from the boat 28, bend the poles 12 in the opposite direction so that the portable cover structure 10 extends over the dock 16, and affix the straps or cords 18 to the dock, as described herein. After boating, the user may moor the boat 28 to the dock 16, detach the straps or cords 18 from the dock 16, bend the poles 12 outwardly over the boat 28, and then affix the straps or cords 18 to the boat 28, as shown.

Although the present invention has been described in considerable detail with reference to certain preferred versions thereof, other versions are possible. Therefore, the spirit and scope of the appended claims should not be limited to the description of the preferred versions contained herein. All features disclosed in this specification may be replaced by alternative features serving the same, equivalent or similar purpose, unless expressly stated otherwise. Thus, unless expressly stated otherwise, each feature disclosed is one example only of a generic series of equivalent or similar features.

The invention claimed is:

1. A portable cover structure system comprising:

a pair of flexible poles disposed in generally parallel relation, each pole having a first end and a second end;

a sunscreen made of flexible material, wherein said sunscreen is attached to both poles and is stretched therebetween;

a pair of dock mounts that are attached to an immobile, stationary structure selected from the group of a dock or pier, wherein said first end of each pole is removably attachable to one of said dock mounts;

wherein said second end of each pole includes a strap having a first end attached to said pole, and a second end;

a pair of attachment means that are fixedly attached to said immobile, stationary structure, wherein each said attachment means is removably connected to said second end of one of said straps;

wherein said second ends of said straps are alternately attachable to said attachment means in a first position, where said sunscreen is positioned over said immobile, stationary structure, or to a boat in a second position, wherein said sunscreen is positioned over said boat.

2. The portable cover structure system set forth in claim 1, wherein said poles are made from pole sections that may be assembled in longitudinal fashion to form said pole, and wherein said poles may be disassembled for storage and transport.

3. The portable cover structure system set forth in claim 2, wherein said pole sections are connected to one another via an elastic cord.

4. The portable cover structure system set forth in claim 1, wherein said attachment means comprises snap fit mechanisms, each snap fit mechanism having a first portion and a second portion that are removably attachable to one another, and wherein said first portion of said snap-fit mechanism is attached to a distal end of said strap, and said second portion of said snap fit mechanism is attached to said stationary structure.

5. The portable cover structure system set forth in claim 1, wherein said straps include adjustment means for adjusting a length of said strap in order to increase or reduce said length of said strap.

6. The portable cover structure system set forth in claim 1, wherein said sunscreen is removably attached to said poles.

7. A method for providing shade for a boat, said method comprising the steps of:

providing a pair of flexible poles having a first end and a second end;

affixing said first end of said poles to a stationary structure selected from the group consisting of a dock or a pier;

attaching a strap to said second end of each pole, each said strap having a first end and a second end;

providing a sunscreen made of flexible material attaching said sunscreen to both poles so that said sunscreen is disposed between said poles;

affixing a first pair of attachment means to said stationary structure;

mooring a boat to said stationary structure;

affixing a second pair of attachment means to said boat;

selecting between a first position, wherein said second end of said straps are attached to said first pair of attachment means disposed on said stationary structure so that said sunscreen provides shade over said stationary structure, and a second position, wherein said second end of said straps are attached to said second pair of attachment means disposed on said boat, so that said sunscreen provides shade over said boat; and attaching said second ends of said straps to either said first pair of attachment means or said second pair of attachment means.

8. The method set forth in claim 7, wherein said first pair of attachment means and said second pair of attachment means are selected from the group consisting of cleats and a snap-fit mechanisms.

9. The method set forth in claim 7, further including the step of:

positioning said sunshade in said first position so that said sunscreen provides shade over said stationary structure; and unmooring said boat from said stationary structure while said sunscreen is in said first position, so that said stationary structure remains in said first position while said boat is underway.

* * * * *